US008651692B2

(12) United States Patent
Yang

(10) Patent No.: US 8,651,692 B2
(45) Date of Patent: Feb. 18, 2014

(54) LED BASED LAMP AND LIGHT EMITTING SIGNAGE

(75) Inventor: Haitao Yang, San Jose, CA (US)

(73) Assignee: Intematix Corporation, Fremont, CA (US)

( * ) Notice: Subject to any disclaimer, the term of this patent is extended or adjusted under 35 U.S.C. 154(b) by 269 days.

(21) Appl. No.: 12/815,644

(22) Filed: Jun. 15, 2010

(65) Prior Publication Data

US 2010/0321919 A1 Dec. 23, 2010

Related U.S. Application Data

(60) Provisional application No. 61/218,263, filed on Jun. 18, 2009.

(51) Int. Cl.

| | |
|---|---|
| ***F21V 1/00*** | (2006.01) |
| ***F21V 11/00*** | (2006.01) |
| ***F21V 9/16*** | (2006.01) |

(52) U.S. Cl.

USPC ..... 362/235; 362/84

(58) Field of Classification Search

USPC ..... 362/600, 606, 609, 619, 623, 617, 616, 362/613, 607, 608, 601

See application file for complete search history.

(56) References Cited

U.S. PATENT DOCUMENTS

| | | | |
|---|---|---|---|
| 3,290,255 | A | 12/1966 | Smith |
| 3,593,055 | A | 7/1971 | Geusic et al. |
| 3,670,193 | A | 6/1972 | Thorington et al. |
| 3,676,668 | A | 7/1972 | Collins et al. |
| 3,691,482 | A | 9/1972 | Pinnow et al. |
| 3,709,685 | A | 1/1973 | Hercock et al. |
| 3,743,833 | A | 7/1973 | Martie et al. |
| 3,763,405 | A | 10/1973 | Mitsuhata |
| 3,793,046 | A | 2/1974 | Wanmaker et al. |
| 3,819,973 | A | 6/1974 | Hosford |

(Continued)

FOREIGN PATENT DOCUMENTS

| | | | |
|---|---|---|---|
| CN | 2898560 | Y | 5/2007 |
| CN | 201014300 | Y | 1/2008 |

(Continued)

OTHER PUBLICATIONS

International Search Report and Written Opinion dated Aug. 19, 2010 for International Application No. PCT/US2010/038880, 7 pages.

(Continued)

*Primary Examiner* — Anh T. Mai
*Assistant Examiner* — Zachary J Snyder
(74) *Attorney, Agent, or Firm* — Vista IP Law Group, LLP

(57) ABSTRACT

An LED based lamp comprises: an enclosure with an opening that comprises a light emission plane through which light is emitted from the lamp; a plurality of LEDs located along at least one wall of the enclosure and operable to generate light of a first wavelength range, wherein the LEDs are configured such that in operation their emission axis is oriented within a plane that is substantially parallel with or directed away from the light emission plane; and a first light reflective surface located on the base of the enclosure and configured such that in operation light is reflected through the light emission plane. A light emitting sign comprises the lamp of the invention with a light transmissive display surface overlying the light emission plane.

26 Claims, 9 Drawing Sheets

(56) References Cited

U.S. PATENT DOCUMENTS

| | | | | |
|---|---|---|---|---|
| 3,819,974 | A | 6/1974 | Stevenson et al. | |
| 3,849,707 | A | 11/1974 | Braslau et al. | |
| 3,875,456 | A | 4/1975 | Kana et al. | |
| 3,932,881 | A | 1/1976 | Mita et al. | |
| 3,937,998 | A | 2/1976 | Verstegen et al. | |
| 3,972,717 | A | 8/1976 | Wiedemann | |
| 4,035,085 | A | 7/1977 | Seiner | |
| 4,047,075 | A | 9/1977 | Schober? | |
| 4,081,764 | A | 3/1978 | Christmann et al. | |
| 4,104,076 | A | 8/1978 | Pons | |
| 4,143,394 | A | 3/1979 | Schoberl | |
| 4,176,294 | A | 11/1979 | Thornton, Jr. | |
| 4,176,299 | A | 11/1979 | Thornton | |
| 4,211,955 | A | 7/1980 | Ray | |
| 4,305,019 | A | 12/1981 | Graff et al. | |
| 4,315,192 | A | 2/1982 | Skwirut et al. | |
| 4,443,532 | A | 4/1984 | Joy et al. | |
| 4,559,470 | A | 12/1985 | Murakami et al. | |
| 4,573,766 | A | 3/1986 | Bournay, Jr. et al. | |
| 4,584,631 | A | 4/1986 | Cody et al. | |
| 4,618,555 | A | 10/1986 | Suzuki et al. | |
| 4,638,214 | A | 1/1987 | Beers et al. | |
| 4,667,036 | A | 5/1987 | Iden et al. | |
| 4,678,285 | A | 7/1987 | Ohta et al. | |
| 4,727,003 | A | 2/1988 | Ohseto et al. | |
| 4,772,885 | A | 9/1988 | Uehara et al. | |
| 4,845,223 | A | 7/1989 | Seybold et al. | |
| 4,859,539 | A | 8/1989 | Tomko et al. | |
| 4,915,478 | A | 4/1990 | Lenko et al. | |
| 4,918,497 | A | 4/1990 | Edmond | |
| 4,946,621 | A | 8/1990 | Fouassier et al. | |
| 4,992,704 | A | 2/1991 | Stinson | |
| 5,077,161 | A | 12/1991 | Law | |
| 5,110,931 | A | 5/1992 | Dietz et al. | |
| 5,126,214 | A | 6/1992 | Tokailin et al. | |
| 5,131,916 | A | 7/1992 | Eichenauer et al. | |
| 5,136,483 | A * | 8/1992 | Schoniger et al. | 362/545 |
| 5,143,433 | A | 9/1992 | Farrell | |
| 5,143,438 | A | 9/1992 | Giddens et al. | |
| 5,166,761 | A | 11/1992 | Olson et al. | |
| 5,208,462 | A | 5/1993 | O'Connor et al. | |
| 5,210,051 | A | 5/1993 | Carter, Jr. | |
| 5,211,467 | A | 5/1993 | Seder | |
| 5,237,182 | A | 8/1993 | Kitagawa et al. | |
| 5,264,034 | A | 11/1993 | Dietz et al. | |
| 5,283,425 | A | 2/1994 | Imamura | |
| 5,369,289 | A | 11/1994 | Tamaki et al. | |
| 5,405,709 | A | 4/1995 | Littman et al. | |
| 5,439,971 | A | 8/1995 | Hyche | |
| 5,518,808 | A | 5/1996 | Bruno et al. | |
| 5,535,230 | A | 7/1996 | Abe | |
| 5,557,168 | A | 9/1996 | Nakajima et al. | |
| 5,563,621 | A | 10/1996 | Silsby | |
| 5,578,839 | A | 11/1996 | Nakamura et al. | |
| 5,583,349 | A | 12/1996 | Norman et al. | |
| 5,585,640 | A | 12/1996 | Huston et al. | |
| 5,619,356 | A | 4/1997 | Kozo et al. | |
| 5,660,461 | A | 8/1997 | Ignatius et al. | |
| 5,677,417 | A | 10/1997 | Muellen et al. | |
| 5,679,152 | A | 10/1997 | Tischler et al. | |
| 5,763,901 | A | 6/1998 | Komoto et al. | |
| 5,770,887 | A | 6/1998 | Tadatomo et al. | |
| 5,771,039 | A | 6/1998 | Ditzik | |
| 5,777,350 | A | 7/1998 | Nakamura et al. | |
| 5,803,592 | A | 9/1998 | Lawson | |
| 5,869,199 | A | 2/1999 | Kido | |
| 5,959,316 | A | 9/1999 | Lowery | |
| 5,962,971 | A | 10/1999 | Chen | |
| 5,998,925 | A | 12/1999 | Shimizu et al. | |
| 6,084,250 | A | 7/2000 | Justel et al. | |
| 6,137,217 | A | 10/2000 | Pappalardo et al. | |
| 6,340,824 | B1 | 1/2002 | Komoto et al. | |
| 6,350,041 | B1 | 2/2002 | Tarsa et al. | |
| 6,471,371 | B1 | 10/2002 | Kawashima et al. | |
| 6,504,301 | B1 | 1/2003 | Lowery | |
| 6,576,488 | B2 | 6/2003 | Collins et al. | |
| 6,599,002 | B2 | 7/2003 | Hsieh et al. | |
| 6,600,175 | B1 | 7/2003 | Baretz et al. | |
| 6,642,618 | B2 | 11/2003 | Yagi et al. | |
| 6,642,652 | B2 | 11/2003 | Collins et al. | |
| 6,844,903 | B2 | 1/2005 | Mueller-Mach et al. | |
| 6,869,812 | B1 | 3/2005 | Liu | |
| 7,153,015 | B2 | 12/2006 | Brukilacchio | |
| 7,237,925 | B2 | 7/2007 | Mayer et al. | |
| 7,311,858 | B2 | 12/2007 | Wang | |
| 7,390,437 | B2 | 6/2008 | Dong et al. | |
| 7,479,662 | B2 | 1/2009 | Soules et al. | |
| 7,575,697 | B2 | 8/2009 | Li | |
| 7,601,276 | B2 | 10/2009 | Li | |
| 7,604,384 | B2 | 10/2009 | Peck | |
| 7,615,795 | B2 | 11/2009 | Baretz et al. | |
| 7,630,028 | B2 | 12/2009 | Wang et al. | |
| 7,915,627 | B2 | 3/2011 | Li et al. | |
| 7,943,945 | B2 | 5/2011 | Baretz et al. | |
| 8,274,215 | B2 | 9/2012 | Liu et al. | |
| 2003/0042845 | A1 | 3/2003 | Pires et al. | |
| 2004/0008504 | A1 | 1/2004 | Wang et al. | |
| 2004/0016938 | A1 | 1/2004 | Baretz et al. | |
| 2005/0140849 | A1 | 6/2005 | Hoelen et al. | |
| 2006/0001036 | A1 | 1/2006 | Jacob et al. | |
| 2006/0027786 | A1 | 2/2006 | Dong et al. | |
| 2006/0028122 | A1 | 2/2006 | Wang et al. | |
| 2006/0049416 | A1 | 3/2006 | Baretz et al. | |
| 2006/0145123 | A1 | 7/2006 | Li et al. | |
| 2006/0158090 | A1 | 7/2006 | Wang et al. | |
| 2006/0261309 | A1 | 11/2006 | Li et al. | |
| 2006/0268537 | A1 | 11/2006 | Kurihara et al. | |
| 2007/0029526 | A1 | 2/2007 | Cheng et al. | |
| 2007/0070623 | A1 * | 3/2007 | Laski | 362/235 |
| 2007/0081780 | A1 | 4/2007 | Scholl | |
| 2007/0153526 | A1 | 7/2007 | Lim | |
| 2007/0228931 | A1 | 10/2007 | Kim et al. | |
| 2007/0240346 | A1 | 10/2007 | Li et al. | |
| 2007/0274096 | A1 | 11/2007 | Chew et al. | |
| 2007/0297179 | A1 | 12/2007 | Leung et al. | |
| 2008/0111472 | A1 | 5/2008 | Liu et al. | |
| 2008/0192458 | A1 | 8/2008 | Li | |
| 2008/0204888 | A1 | 8/2008 | Kan et al. | |
| 2008/0218993 | A1 | 9/2008 | Li | |
| 2008/0224597 | A1 | 9/2008 | Baretz et al. | |
| 2008/0224598 | A1 | 9/2008 | Baretz et al. | |
| 2009/0059856 | A1 | 3/2009 | Kermoal et al. | |
| 2009/0101930 | A1 | 4/2009 | Li | |
| 2009/0168428 | A1 | 7/2009 | Huang | |
| 2009/0283721 | A1 | 11/2009 | Liu et al. | |
| 2009/0296383 | A1 | 12/2009 | Valster et al. | |
| 2009/0316414 | A1 | 12/2009 | Yang et al. | |
| 2010/0027293 | A1 | 2/2010 | Li | |
| 2010/0172152 | A1 | 7/2010 | Boonekamp | |

FOREIGN PATENT DOCUMENTS

| | | | |
|---|---|---|---|
| CN | 201028327 | Y | 2/2008 |
| CN | 101270855 | A | 9/2008 |
| CN | 101422307 | A | 5/2009 |
| CN | 101451656 | A | 6/2009 |
| CN | 102460003 | | 5/2012 |
| CN | 102498337 | | 6/2012 |
| EP | 0395775 | | 11/1990 |
| EP | 0534140 | | 3/1993 |
| EP | 647694 | | 4/1995 |
| GB | 2 017 409 | | 10/1979 |
| JP | 48-20539 | | 3/1973 |
| JP | 50-79379 | | 11/1973 |
| JP | S50-79379 | | 11/1973 |
| JP | 60170194 | | 9/1985 |
| JP | 862-189770 | | 8/1987 |
| JP | H01-1794 71 | | 7/1989 |
| JP | 01-260707 | | 10/1989 |
| JP | H02-91980 | | 3/1990 |
| JP | H3-24692 | | 3/1991 |
| JP | 4010665 | | 1/1992 |
| JP | 4010666 | | 1/1992 |
| JP | 04-269718 | | 9/1992 |

(56) References Cited

FOREIGN PATENT DOCUMENTS

| | | |
|---|---|---|
| JP | 04-289691 | 10/1992 |
| JP | 4-321280 | 11/1992 |
| JP | 05-152609 | 6/1993 |
| JP | 6207170 | 7/1994 |
| JP | 6-267301 | 9/1994 |
| JP | 06-267301 | 9/1994 |
| JP | 6283755 | 10/1994 |
| JP | 07-099345 | 4/1995 |
| JP | 07-176794 | 7/1995 |
| JP | H07-176794 | 7/1995 |
| JP | 07-235207 | 9/1995 |
| JP | H7-282609 | 10/1995 |
| JP | H08-7614 | 1/1996 |
| JP | 8-250281 | 9/1996 |
| JP | 2900928 | 3/1999 |
| JP | P2003-234513 | 8/2003 |
| JP | P3724490 | 9/2005 |
| JP | P3724498 | 9/2005 |
| TW | 201111704 | 4/2011 |
| TW | 201129761 | 9/2011 |
| WO | WO 9108508 | 6/1991 |
| WO | WO 94/00973 | 1/1994 |
| WO | WO 2010/148129 | 12/2010 |
| WO | WO 2011/019753 | 2/2011 |

OTHER PUBLICATIONS

International Search Report and Written Opinion dated Oct. 21, 2010 for International Application No. PCT/US2010/045074, 10 pages.
Non-Final Office Action dated Sep. 28, 2011 for U.S. Appl. No. 12/852,760.
Notice of Allowance and Fee(s) Due dated Feb. 9, 2012 for U.S. Appl. No. 12/852,760.
Non-Final Office Action dated Aug. 29, 2011 for U.S. Appl. No. 13/073,395.
Notice of Allowance dated Jan. 31, 2012 for U.S. Appl. No. 13/073,395.
International Search Report and Written Opinion dated Dec. 12, 2008 for International Application No. PCT/US08/080230, 8 pages.
Non-Final Office Action dated May 24, 2010 for U.S. Appl. No. 11/975,130.
Notice of Allowance dated Nov. 22, 2010 for U.S. Appl. No. 11/975,130.
Office Action dated Jan. 30, 2013 for Taiwanese Appln. No. 101119190.
Office Action dated Mar. 5, 2013 for Japanese Appln. No. 2010-530125.
Non-Final Office Action dated Jun. 12, 2013 for U.S. Appl. No. 13/481,565.
Foreign Office Action dated Apr. 9, 2013 for Chinese Appln. No. 200880111717.6.
"Fraunhofer-Gesellschafl: Research News Special1997", http://www.fhg.de/press/md-e/md1997/sondert2.hlm,(accessed on Jul. 23, 1998), Jan. 1997, Publisher: Fraunhofer Institute.
Adachi, C. et al., "Blue light-emitting organic electroluminescent devices", "Appl. Phys. Lett.", Feb. 26, 1990, pp. 799-801, vol. 56, No. 9.
Akasaki, Isamu, et al., "Photoluminescence of Mg-doped p-type GaN and electroluminescence of GaN p-n junction LED", "Journal of Luminescence", Jan.-Feb. 1991, pp. 666-670, vol. 48-49 pt. 2.
Amano, H., et al., "UV and blue electroluminescence from Al/GaN:Mg/GaN LED treated with low-energy electron beam irradiation (LEEBI)", "Institute of Physics: Conference Series", 1990, pp. 725-730, vol. 106, No. 10.
Apr. 14, 2010 Office Action in U.S. Appl. No. 11/264,124.
Apr. 15, 2009 Office Action in U.S. Appl. No. 11/264,124.
Armaroli, N. et al., "Supramolecular Photochemistry and Photophysics. ", "J. Am. Chern. Soc.", 1994, pp. 5211-5217, vol. 116.
Aug. 21, 2006 Office Action in U.S. Appl. No. 10/623,198, issued by Thao X. Le.
Aug. 24, 2007 Office Action in U.S. Appl. No. 11/264,124, issued by Thao X. Le.
Aug. 26, 2010 Office Action in U.S. Appl. No. 12/131,118.
Berggren, M. et al., "Light-emitting diodes with variable colours from polymer blends", "Nature", Dec. 1, 1994, pp. 444-446, vol. 372.
Berggren, M., et al., "White light from an electroluminescent diode made from poly[3(4-octylphenyl)-2,2'-bithiophene] and an oxadiazole . . . ", "Journal of Applied Physics", Dec. 1994, pp. 7530-7534, vol. 76, No. 11.
Boonkosum, W. et al., "Novel Flat Panel display made of amorphous SiN:H/SiC:H thin film LED", "Physical Concepts and Materials for Novel Optoelectronic Device Applications II", 1993, pp. 40-51, vol. 1985.
Bradfield, P.L., et al., "Electroluminescence from sulfur impurities in a p-n junction formed in epitaxial silicon", "Appl. Phys. Lett", 07110/1989, pp. 10D-102, vol. 55, No. 2.
Chao, Zhang Jin, et al., "White light emitting glasses", "Journal of Solid State Chemistry", 1991, pp. 17-29, vol. 93.
Comrie, M. , "Full Color LED Added to Lumex's Lineup", "EBN", Jun. 19, 1995, p. 28.
CRC Handbook, 63rd Ed., (1983) p. E-201.
Das, N.C., et al., "Luminescence spectra of ann-channel metal-oxide-semiconductor field-effect transistor at breakdown", 1990, pp. 1152-1153, vol. 56, No. 12.
Dec. 16. 2004 Office Action in U.S. Appl. No. 10/623,198, issued by Thao X. Le.
Dictionary Definition of Phosphor, Oxford English Dictionary Online, Mar. 9, 2012 (Only partial available due to corrupt file on Mar. 22, 2012 in U.S. Appl. No. 12/131,119; Request for Full Reference filed).
El Jouhari, N., et al., "White light generation using fluorescent glasses activated by Ce3+, Tb3+ and Mn2+ ions", "Journal De Physique IV, Colloque C2", Oct. 1992, pp. 257-260, vol. 2.
Feb. 21, 2012 Office Action in U.S. Appl. No. 12/131,118, issued by Abul Kalam.
Feb. 26, 2008 Office Action in U.S. Appl. No. 11/264,124, issued by Abu I Kalam.
Feb. 4, 2005 Office Action in U.S. Appl. No. 10/623,198, issued by Thao X. Le.
Feb. 7, 2007 Office Action in U.S. Appl. No. 11/264,124, issued by Thao X. Le.
Forrest, S. et al. , "Organic emitters promise a new generation of displays", "Laser Focus World ", Feb. 1995, pp. 99-107.
Hamada, Y. et al. , "Blue-Light-Emitting Organic Electroluminescent Devices with Oxadiazole Dimer Dyes as an Emitter", "Jpn. J. Appl. Physics", Jun. 1992, pp. 1812-1816, vol. 31.
Hamakawa, Yoshihiro, et al., "Toward a visible light display by amorphous SiC:H alloy system", "Optoelectronics—Devices and Technologies", Dec. 1989, pp. 281-294, vol. 4, No. 2.
Hirano, Masao, et al., "Various performances of fiber-optical temperature sensor utilizing infrared-to-visible conversion phosphor", "Electrochemisty (JP)", Feb. 1987, pp. 158-164, vol. 55, No. 2, Publisher: Electrochemical Society of Japan.
Jang, S., "Effect of Avalanche-Induced Light Emission on the Multiplication Factor in Bipolar Junction Transistors", "Solid-State Electronics", 1991, pp. 1191-1196, vol. 34, No. 11.
Jan. 29, 2007 Office Action in U.S. Appl. No. 10/623,198, issued by Thao X. Le.
Jan. 30, 2006 Office Action in U.S. Appl. No. 11/264,124, issued by Thao X. Le.
Jan. 7, 2011 Office Action in U.S. Appl. No. 12/131,119, issued by Steven Y. Horikoshi.
Jul. 10, 2008 Office Action in U.S. Appl. No. 11/264,124, issued by Abu I Kalam.
Jul. 14, 2005 Notice of Allowance, Notice of Allowability, and Examiner's Statement of Reasons for Allowance in U.S. Appl. No. 10/623,198, issued by Thao X. Le.
Jul. 14, 2011 Office Action in U.S. Appl. No. 12/131,119, issued by Steve Horikoshi.
Jul. 7, 2011 Office Action in U.S. Appl. No. 12/131,118, issued by Abu I Kalam.
Jun. 14, 2006 Office Action in U.S. Appl. No. 11/264,124, issued by Thao X. Le.

(56) References Cited

OTHER PUBLICATIONS

Jun. 26, 2007 Office Action in U.S. Appl. No. 10/623,198, issued by Thao X. Le.
Kido, J. et al. , "1,2,4-Triazole Derivative as an Electron Transport Layer in Organic Luminescent Devices", "Jpn. J. Appl. Phys. ", Jul. 1, 1993, pp. L917-L920, vol. 32.
Kido, J. et al. , "Bright blue electroluminescence from poly(N-vinylcarbazole)", "Appl. Phys. Letters", Nov. 8, 1993, pp. 2627-2629, vol. 63, No. 19.
Kido, J., et al., "White light-emitting organic electroluminescent devices using the poly(N-vinylcarbazole) emitter layer doped with . . . ", "Appl. Phys. Lett.", Feb. 14, 1994, pp. 815-817, vol. 64, No. 7.
Krames, M., et al., "Status and Future of High-Power Light-Emitting Diodes for Solid-Slate Lighting", "Journal of Display Technology", Jun. 2007, pp. 160-175, vol. 3, No. 2.
Kudryashov, V., et al., "Spectra of Superbright Blue and Green InGaN/AIGaN/GaN Light-Emitting diodes", "Journal of the European Ceramic Society", May 1996, pp. 2033-2037, vol. 17.
Larach, S., et al., "Blue emitting luminescent phosphors: Review and status", "Int'l Workshop on Electroluminescence", 1990, pp. 137-143.
LEDs and Laser Diodes, Electus Distribution, copyright 2001, available at URL:http://www .jaycarcom.au/images_uploaded/ledlaser.Pdf.
Lester, S., et al., "High dislocation densities in high efficiency GaN-based light-emitting diodes", "Appl. Phys. Lett.", Mar. 6, 1995, pp. 1249-1251, vol. 66, No. 10.
Lumogen® F Violet 570 Data Sheet; available at the BASF Chemical Company website Lumogen® F Violet 570 Data Sheet; available at the BASF Chemical Company website URL,http://worldaccount.basf.com/wa/EUen_GB/Catalog/Pigments/doc4/BASF/PRD/30048274/.pdt?title=Technicai%20Datasheet&asset_type=pds/pdf&language=EN&urn=urn:documentum:eCommerce_soi_EU :09007bb280021e27.pdf :09007bb280021e27.pdf.
Mar. 2, 2009 Office Action in U.S. Appl. No. 10/623,198, issued by Abu I Kalam.
Mar. 22, 2012 Office Action in U.S. Appl. No. 12/131,119, issued by Steven Y. Horikoshi.
Mar. 28, 2006 Office Action in U.S. Appl. No. 10/623,198, issued by Thao X. Le.
Mar. 4, 2011 Notice of Allowance, Notice of Allowability, Examiner's Interview Summary, Examiner's Amendment/ Comment and Examiner's Statement of Reason for Allowance in U.S. Appl. No. 11/264,124, issued by Abu I Kalam.
Mar. 7, 2008 Office Action in U.S. Appl. No. 10/623,198, issued by Abu I Kalam.
Maruska, H.P., "Gallium nitride light-emitting diodes (dissertation)", "Dissertation Submitted to Stanford University", Nov. 1973.
Maruska, H.P., et al., "Violet luminescence of Mg-doped GaN", "Appl. Phys. Lett.", Mar. 15, 1973, pp. 303-305, vol. 22, No. 6.
May 4, 2010 Office Action in U.S. Appl. No. 12/131,119.
McGraw-Hill, "McGraw-Hill Dictionary of Scientific and Technical Terms, Third Edition", "McGraw-Hill Dictionary of Scientific and Technical Terms", 1984, p. 912 and 1446, Publisher: McGraw-Hill.
McGraw-Hill, "McGraw-Hill Encyclopedia of Science and Technology, Sixth Edition", "McGraw-Hill Encyclopedia of Science and Technology", 1987, p. 582 and 60-63, vol. 9-10, Publisher: McGraw-Hill.
Mimura, Hidenori, et al., "Visible electroluminescence from uc-SiC/porous Si/c-Si p-n junctions", "Int. J. Optoelectron.", 1994, pp. 211-215, vol. 9, No. 2.
Miura, Noboru, et al., "Several Blue-Emitting Thin-Film Electroluminescent Devices", "Jpn. J. Appl. Phys.", Jan. 15, 1992, pp. L46-L48, vol. 31, No. Part 2, No. 1A IB.
Morkoc et al., "Large-band-gap SIC, 111-V nitride, and II-VI ZnSe-based semiconductor device technologies", J. Appl. Phys. 76(3), 1; Mar. 17, 1994; Illinois University.
Muench, W.V., et al., "Silicon carbide light-emitting diodes with epitaxial junctions", "Solid-State Electronics", Oct. 1976, pp. 871-874, vol. 19, No. 10.
Mukai, T., et al., "Recent progress of nitride-based light emitting devices", "Phys. Stat. Sol.", Sep. 2003, pp. 52-57, vol. 200, No. 1.
Nakamura, S., et al., "High-power InGaN single-quantum-well-structure blue and violet light-emitting diodes", "Appl. Phys. Lett.", Sep. 25, 1995, pp. 1868-1870, vol. 67, No. 13.
Nakamura, S., et al., "The Blue Laser Diode: GaN Based Light Emitters and Lasers", Mar. 21, 1997, p. 239, Publisher: Springer-Verlag.
Nakamura, S., et al., "The Blue Laser Diode: The Complete Story, 2nd Revised and Enlarged Edition", Oct. 2000, pp. 237-240, Publisher: Springer-Verlag.
Nov. 30, 2010 Office Action in U.S. Appl. No. 12/131,118.
Oct. 20, 2008 Office Action in U.S. Appl. No. 10/623,198, issued by Abu I Kalam.
Pankove, J.I., et al., "Scanning electron microscopy studies of GaN", "Journal of Applied Physics", Apr. 1975, pp. 1647-1652, vol. 46, No. 4.
Pavan, P., et al., "Explanation of Current Crowding Phenomena Induced by Impact Ionization in Advanced Si Bipolar Transistors by Means of . . . ", "Microelectronic Engineering", 1992, pp. 699-702, vol. 19.
Pei, Q, et al., "Polymer Light-Emitting Electrochemical Cells", "Science", Aug. 25, 1995, pp. 1086-1088, vol. 269, No. 5227.
Reexam Advisory Action dated Sep. 28, 2012 for U.S. Appl. No. 90/010,940.
Reexam Final Office Action dated May 24, 2012 for U.S. Appl. No. 90/010,940.
Reexam Final Office Action dated Nov. 7, 2011 for U.S. Appl. No. 90/010,940.
Reexam Non-Final Office Action dated Jan. 26, 2012 for U.S. Appl. No. 90/010,940.
Reexam Non-Final Office Action dated Mar. 3, 2011 for U.S. Appl. No. 90/010,940.
Reexam Non-Final Office Action dated Sep. 20, 2010 for U.S. Appl. No. 90/010,940.
Roman. D., "LEDs Turn A Brighter Blue", "Electronic Buyers' News", Jun. 19, 1995, pp. 28 and 35, vol. 960, Publisher: CMP Media LLC.
Saleh and Teich, Fundamentals of Photonics, New York: John Wiley & Sons, 1991, pp. 592-594.
Sato, Yuichi, et al., "Full-color fluorescent display devices using a near-UV light-emitting diode", "Japanese Journal of Applied Physics", Jul. 1996, pp. L838-L839, vol. 35, No. ?A.
Sep. 17, 2009 Notice of Allowance, Notice of Allowability, Examiner's Amendmeni/Comment, and Examiner's Statement of Reasons for Allowance in U.S. Appl. No. 10/623,198, issued by Abul Kalam.
Sep. 29, 2009 Office Action in U.S. Appl. No. 11/264,124, issued by Abu I Kalam.
Tanaka, Shosaku, et al., "Bright white-light electroluminescence based on nonradiative energy transfer in Ce-and Eu-doped SrS thin films", "Applied Physics Letters", Nov. 23, 1987, pp. 1661-1663, vol. 51, No. 21.
Tanaka, Shosaku, et al., "White Light Emitting Thin-Film Electroluminescent Devices with SrS:Ce,CI/ZnS:Mn Double Phosphor Layers", "Jpn. J. Appl. Phys.", Mar. 20, 1986, pp. L225-L227, vol. 25, No. 3.
The Penguin Dictionary of Electronics, 3rd edition, pp. 315,437-438, 509-510, copyright 1979, 1988, and 1998.
Ura, M. , "Recent trends of development of silicon monocarbide blue-light emission diodes", "Kinzoku", 1989, pp. 11-15, vol. 59, No. 9.
Werner, K. , "Higher Visibility for LEDs", "IEEE Spectrum", Jul. 1994, pp. 30-39.
Wojciechowski, J. et al. , "Infrared-To-Blue Up-Converting Phosphor", "Electron Technology", 1978, pp. 31-47, vol. 11, No. 3.
Yamaguchi, Y. et al., "High-Brightness SiC Blue LEDs and Their Application to Full Color LED Lamps", "Optoelectronics-Devices and Technologies", Jun. 1992, pp. 57-67, vol. 7, No. 1.
Yang, Y., et al., "Voltage controlled two color light-emitting electrochemical cells", "Appl. Phys. Lett.", 1996, vol. 68, No. 19.

(56) References Cited

OTHER PUBLICATIONS

Yoshimi, Masashi, et al., "Amorphous carbon basis blue light electroluminescent device", "Optoelectronics—Devices and Technologies", Jun. 1992, pp. 69-81, vol. 7, No. 1.
Zanoni, E., et al., "Impact ionization, recombination, and visible light emission in ALGaAs/GaAs high electron mobility transistors", "J. Appl. Phys.", 1991, pp. 529-531, vol. 70, No. 1.
Zanoni, E., et al., "Measurements of Avalanche Effects and Light Emission in Advanced Si and SiGe Bipolar Transistors", "Microelectronic Engineering", 1991, pp. 23-26, vol. 15.
Zdanowski, Marek, "Pulse operating up-converting phosphor LED", "Electron Technol. ", 1978, pp. 49-61, vol. 11, No. 3.
Zhiming, Chen, et al., "Amorphous thin film white-LED and its light-emitting mechanism", "Conference Record of the 1991 International Display Research Conference", Oct. 1991, pp. 122-125.
Foreign Office Action dated Jun. 19, 2013 for Chinese Appln. No. 201080034323.2.
Foreign Office Action dated Jun. 14, 2013 for Chinese Appln. No. 201080041264.1.
Notice of Allowance dated Nov. 12, 2013 for U.S. Appl. No. 13/481,565.

* cited by examiner

LED BASED LAMP AND LIGHT EMITTING SIGNAGE

PRIORITY CLAIM

This application claims the benefit of priority of U.S. Provisional Application No. 61/218,263, filed Jun. 18, 2009, entitled "LED Based Lamp and Light Emitting Signage" by Haitao Yang, the contents of which are incorporated herein by reference.

BACKGROUND OF THE INVENTION

1. Field of the Invention

This invention relates to LED (Light Emitting Diode) based lamps and LED based light emitting signage. In particular, although not exclusively, the invention concerns a light emitting panel lamp and a back-light or light box for a light emitting sign.

2. Description of the Related Art

A lighting fixture commonly found in offices and commercial premises is a fluorescent lighting panel. Generally, such lighting panels comprise an enclosure housing one or more fluorescent tubes and a front diffusing panel. Typically, the diffusing panel is a translucent plastics material or a light transmissive plastics material with a regular surface patterning to promote a uniform light emission. Alternatively, a light reflective louvered front cover can be used to diffuse the emitted light. Such lighting panels are often intended for use in a suspended (drop) ceiling in which a grid of support members (T bars) are suspended from the ceiling by cables and ceiling tiles supported by the grid of support members. The ceiling tiles can be square or rectangular in shape and the lighting panel module is configured to fit within such openings with the diffusing panel replacing the ceiling tile.

White light emitting LEDs ("white LEDs") are known in the art and are a relatively recent innovation. It was not until high brightness LEDs emitting in the blue/ultraviolet (U.V.) part of the electromagnetic spectrum were developed that it became practical to develop white light sources based on LEDs. As taught, for example in U.S. Pat. No. 5,998,925, white LEDs include one or more phosphor materials, that is photo-luminescent materials, which absorb a portion of the radiation emitted by the LED and re-emit radiation of a different color (wavelength). Typically, the LED chip generates blue light and the phosphor material(s) absorbs a proportion of the blue light and re-emits light of a different color typically yellow or a combination of green and red light, green and yellow light or yellow and red light. The portion of the blue light generated by the LED that is not absorbed by the phosphor material combined with the light emitted by the phosphor material provides light which appears to the eye as being nearly white in color.

Due to their long operating life expectancy (of order 30-50,000 hours) and high luminous efficacy (70 lumens per watt and higher) high brightness white LEDs are increasingly being used to replace conventional fluorescent, compact fluorescent and incandescent bulbs. Today, most lighting fixture designs utilizing white LEDs comprise systems in which a white LED (more typically an array of white LEDs) replaces the conventional light source component. Moreover, due to their compact size, compared with conventional light sources, white LEDs offer the potential to construct novel and compact lighting fixtures.

Co-pending US patent application publication No. US 2007/0240346 (filed Aug. 3, 2006) disclose a back-lit lighting panel which utilizes blue/U.V. emitting LEDs instead of white LEDs. One or more phosphor materials are provided on, or incorporated in, a light transmissive window overlaying the back-light housing the LEDs. An advantage of providing the phosphor remote to the LED is that light generation, photo-luminescence, occurs over the entire surface area of the panel. This can lead to a more uniform color and/or correlated color temperature (CCT) of emitted light. A further advantage of locating the phosphor remote to the LED die (i.e. physically separated from the LED die) is that less heat is transferred to the phosphor, reducing thermal degradation of the phosphor. Additionally the color and/or CCT of light generated by the panel can be changed by changing the phosphor panel (window).

Edge-lit lighting panel lamps are also known in which light is coupled into the edges of a planar light guiding panel (waveguiding medium). The light is guided by total internal reflection throughout the volume of the medium and then emitted from a light emitting face. To reduce light emission from the rear face of the panel (i.e. the face opposite the light emitting face), the rear face will often include a light reflective layer. Moreover to encourage a uniform emission of light one or both faces of the light guiding panel can include a surface patterning such as a hexagonal or square array of circular areas. Each circular area comprises a surface roughening and causes a disruption to the light guiding properties of the light guiding panel at the site of the area resulting in a preferential emission of light at the area.

An advantage of an edge-lit lighting panel lamp compared with a back-lit panel lamp is its compact nature, especially overall depth (thickness) of the lamp which can be comparable with the thickness of the light guiding panel making it possible to construct a lamp of order 15-20 mm in depth. However, a disadvantage of edge-lit lighting panels is that they have a lower luminous efficacy compared with a back-lit arrangement due to light losses within the light guiding medium, losses in coupling light into the medium and losses in extracting light from the medium. Additionally as with back-lit lighting panels the light emission is not truly uniform over the light emitting face. For example there can be "hot spots" along the edges that correspond to the position of the LEDs and a darker region at the centre of the panel.

Co-pending U.S. patent application Ser. No. 12/183,835 (filed Jul. 30, 2008) discloses an LED based edge-lit light emitting panel in which a pattern of optical features (discontinuities) is provided on at least one face of the light guiding medium which are configured to reduce a variation in emitted light intensity over the light emitting surface of the panel. The pattern of features can be configured in dependence on the light intensity distribution within the light guiding medium. To reduce light losses associated with coupling into the light guiding medium the corners of the light guiding medium are truncated and light coupled into the truncated corners. Although such a pattern of features can reduce the variation in emitted light intensity since the panel is edge-lit the luminous efficacy can still be lower than a back-lit arrangement.

Co-pending U.S. patent application Ser. No. 11/827,890 (filed Jul. 13, 2007) describes an edge-lit lighting panel which utilizes blue emitting LEDs instead of white LEDs in which a layer of one or more blue light excitable phosphor materials is provided on the light emitting face of the light guiding panel. A proportion of the blue light emitted from the light emitting face of the panel is absorbed by the phosphor material(s) and one or more other colors of light emitted by the phosphor. For general lighting applications the lamp is configured such that the blue light from the LEDs combined with the phosphor generated light produces an illumination product that appears white in color. Since light generation (photo-luminescence)

occurs over the entire light emitting surface area of the panel this can lead to a more uniform color and/or CCT of light emission. However, such a lighting panel still has the intrinsic losses associated with coupling light into the light guiding medium and extracting light from the panel resulting in a lower luminous efficacy compared with a back-lit arrangement.

In addition to general lighting applications back-lit lighting configurations are extensively used for light emitting signage, such as smaller format bill boards, in which a light transmissive display surface overlies the opening of the light-box enclosure. Often the display surface is in the form of an image printed on paper in which the paper acts a light diffuser and the printed image acts as a light transmissive color filter. Where the sign comprises symbols, characters or simple devices as opposed to complex images it is known to use colored acrylic, polycarbonate or other plastics materials to form the required image.

Co-pending patent application Ser. No. 11/714,711 (Publication US 2007/0240346) filed Jun. 3, 2007 discloses a light emitting sign which utilizes a blue light back-light and in which one or more phosphor materials are provided on the display surface and configured to generate a desired character, symbol or device of a selected color. An advantage of such a sign compared with one in which the display surface acts as a color filter is that the intensity and/or color saturation of emitted light is much greater.

SUMMARY OF THE INVENTION

The present invention arose in an endeavor to provide an LED based lamp and LED based sign, in particular although not exclusively a panel type lamp that is more compact, in particular has a thinner profile (depth), has a greater luminous efficacy and which generates a more uniform intensity of light emission. In this specification back-lit refers to an optical arrangement in which light propagates in free space. This is to be contrasted with lighting arrangements in which light are waveguided within an optical medium as is the case in an edge-lit lighting panel.

According to the invention a lamp comprises: an enclosure with an opening that comprises a light emission plane through which light is emitted from the lamp; a plurality of LEDs located along at least one wall of the enclosure and operable to generate light of a first wavelength range, wherein the LEDs are configured such that in operation their emission axis is oriented within a plane that is substantially parallel with or directed away from the light emission plane; and a first light reflective surface located on the base of the enclosure and configured such that in operation light is reflected through the light emission plane. Since the LEDs emission axis is oriented within a plane that is parallel with or directed away from the light emission plane this enables the thickness (depth) of the lamp to be reduced compared with a back-lit arrangements. Moreover, since light propagates in free space and is not guided within an optical medium this increases the luminous efficacy compared with a conventional edge-lit arrangement. Preferably the emission axis of the LEDs is oriented at an angle in a range 0° to 30° to the light emission plane.

Advantageously the lamp further comprises a second light reflective surface configured to prevent at least a portion of the light emitted by the LEDs being emitted directly (i.e. without reflection) through the light emission plane. Advantageously, the second light reflective surface is configured to prevent light emitted at angle of more than 30° to the light emission plane being emitted directly. Such an arrangement reduces a likelihood of glare or hot spots corresponding to the LEDs.

Preferably, the first and second light reflective surfaces are configured such that a variation in luminous emission intensity over the light emission plane is less than 10% and preferably less than 5%.

In one arrangement the first light reflective surface is arcuate in form, such as convex cylindrical surface that extends between the wall(s) of the enclosure on which the LEDs are located. In another arrangement the first light reflective surface is substantially planar and is oriented substantially parallel with the light emission plane. Preferably, the first light reflective surface further comprises at least one light reflective portion that is oriented at an angle to the light emission plane. Such a portion is preferably located at the periphery of the light reflective surface adjacent to the LEDs and can comprise a beveled surface.

In one implementation the enclosure is quadrilateral in form, typically square or rectangular, and the LEDs are located on opposite walls of the enclosure. In one such arrangement the first light reflective surface comprises a convex cylindrical surface that extends between the walls of the enclosure on which the LEDs are located. In an alternative arrangement the first light reflective surface comprises a substantially planar surface that extends between the walls on the enclosure on which the LEDs are located.

In another implementation the enclosure is circular or elliptical in form and the LEDs are spaced around the wall. In such an arrangement the first light reflective surface comprises an oblate hemi-spheroidal or oblate hemi-ellipsoidal surface located on the base of the enclosure.

Preferably the second light reflective surface extends out from the wall on which the LEDs are located and is proximate to the light emission plane. The second light reflective surface can be planar, arcuate or multi-faceted in form.

To maximize the lamp's luminous efficacy the light reflective surfaces have a reflectance of at least 90%, preferably at least 95% and more preferably at least 98%. Typically the light reflective surfaces comprise a metal or metallization of aluminum, chromium or silver.

In a preferred embodiment the lamp further comprises at least one phosphor (photo-luminescent) material operable to absorb at least a portion of light of the first wavelength range and to emit light of a second wavelength range, wherein the at least one phosphor material is provided at the light emission plane. The phosphor material can be incorporated in a light transmissive window overlying the light emission plane and the at least one phosphor material incorporated in the light transmissive window. To ensure a uniform color of emitted light the phosphor material is distributed substantially uniformly throughout the volume of the light transmissive window. Alternatively the at least one phosphor material comprises at least one layer on at least a part of the surface of the light transmissive window. Preferably the phosphor material layer comprises a pattern of regions without phosphor material that enable back scattered light to be emitted from the lamp. For a panel lamp the light transmissive window can be planar in form though it is envisaged for it to be arcuate in form. The light transmissive window preferably comprises a polymer material such as an acrylic, polycarbonate, silicone material or epoxy though it can comprises a low temperature glass.

For lighting applications light generated by the lamp will appear white in color and will comprise a combination of light of the first and second wavelength ranges. Alternatively the LEDs can be white LEDs that are operable to emit light that appears white in color.

According to a further aspect of the invention a light emitting sign comprises the lamp in accordance with the invention and a light transmissive display surface overlying (generally located at) the light emission plane. In a preferred arrangement the sign comprises at least one phosphor located on the display surface. The phosphor is preferable is configured to be representative of display information such a numeral, letter, device, insignia, indicia, symbols etc.

BRIEF DESCRIPTION OF THE DRAWINGS

In order that the present invention is better understood LED based lamps and a light emitting sign in accordance with embodiments of the invention will now be described, by way of example only, with reference to the accompanying drawings in which.

DETAILED DESCRIPTION OF THE INVENTION

Figure 1:
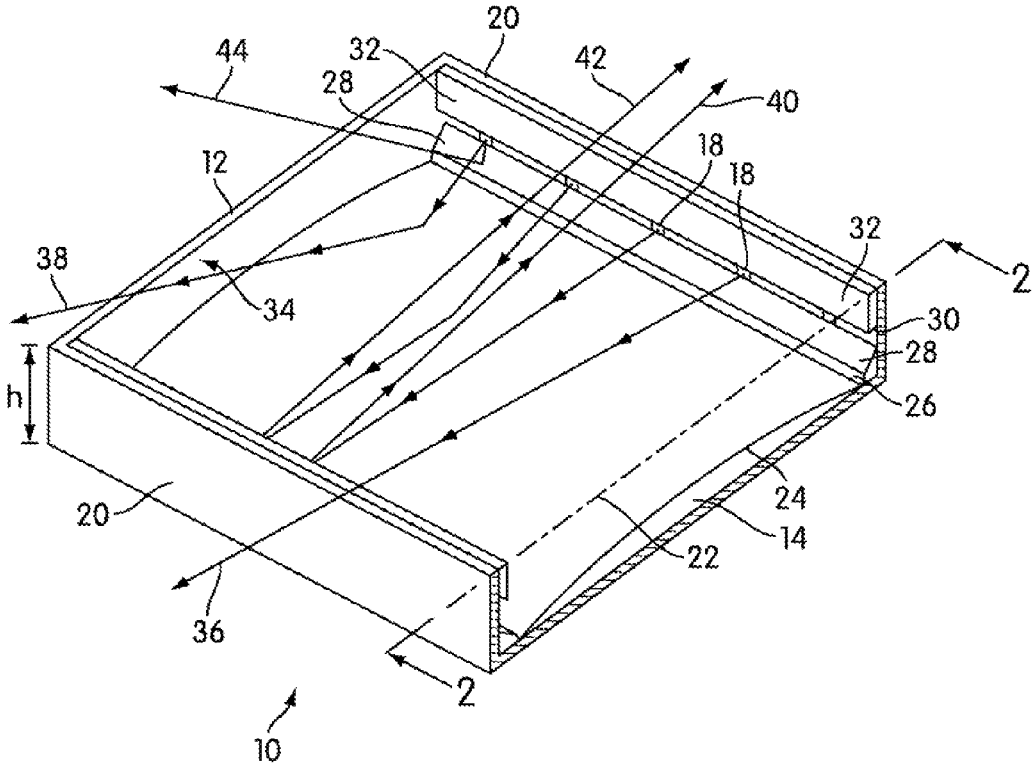
FIG. 1 is a perspective partial cutaway schematic of an LED based lamp in accordance with a first embodiment of the invention.

Embodiments of the invention are directed to LED based lamps in which the LEDs are configured such their axis of emission is oriented within a plane that is generally parallel with or directed away from a light emission plane through which light is emitted from the lamp. The lamp further comprises one or more light reflective surfaces configured such as to reflect light through the light emission plane and/or prevent the direct emission of light through the light emission plane. In this specification like reference numerals are used to denote like parts.

Figure 2:
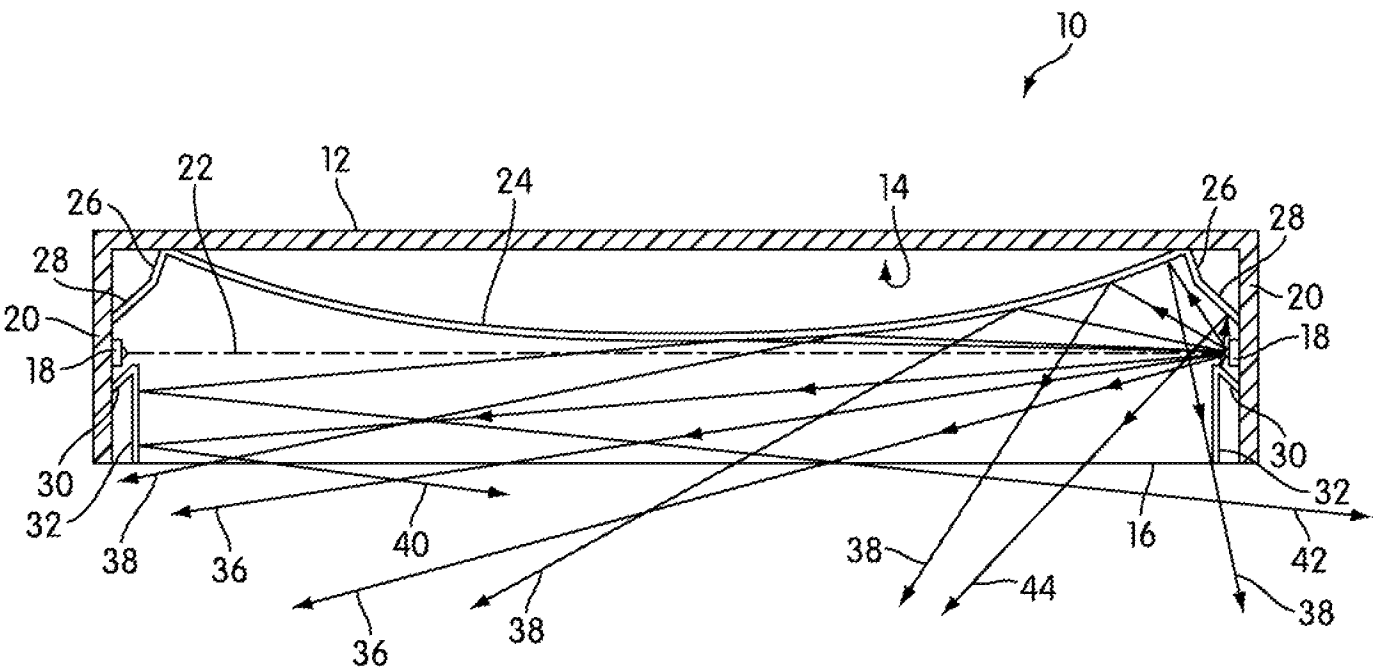
FIG. 2 is a sectional schematic of the lamp of FIG. 1 through a line A-A.

An LED based lamp 10 in accordance with a first embodiment of the invention is now described with reference to FIGS. 1 and 2 in which FIG. 1 is a schematic partial cutaway perspective view of the lamp 10 and FIG. 2 is a schematic sectional view through a line A-A. The lamp 10 is configured to generate white light with a Correlated Color Temperature (CCT) of ≈3000° K, an emission luminous intensity of order 400 lumens (lm) and an emission angle of order 120°.

The lamp 10 comprises an enclosure (housing) 12 which in the example shown is in the form of a shallow square tray with sides of length 25 cm and a depth of order 5 cm. The lamp 10 is intended to be surface mounted on a ceiling, wall or other generally planar surface. It is also envisaged to incorporate the lamp into a suspended (drop) ceiling of a type commonly used in offices and commercial premises in which a grid of support members (T bars) are suspended from the ceiling by cables and ceiling tiles are supported by the grid of support members. Typically ceiling tiles are either square (60 cm×60 cm) or rectangular (120 cm×60 cm) in shape and the enclosure 12 can be readily configured to fit within such size openings. The enclosure 12 can be fabricated from sheet material such as aluminum; die cast or molded from for example a plastics material.

In FIG. 1 the right hand end wall of the enclosure 12 has been removed to enable the interior detail to more readily seen. As illustrated in FIG. 2 the lamp 10 can be configured as a ceiling mountable fixture in which a base 14 of the enclosure is mounted to a ceiling and light is emitted in a downward direction through the opening of the enclosure 12 which constitutes a light emission plane 16. Unless otherwise indicated relative positioning of components will be described with reference to the orientation shown in FIG. 2 such that the base 14 of the enclosure is at the top of the page and the light emission plane (enclosure opening) 16 is at the bottom.

The lamp 10 further comprises a plurality (ten in this example) 1 W (≈40 lm emission luminous intensity) white light emitting GaN (gallium nitride) based LEDs 18 that are positioned along opposite side walls 20 of the enclosure 12. Typically the LEDs 18 are mounted on a substrate (not shown), such as a metal core printed circuit board (MCPCB), which is then mounted to the inner surface of the enclosure wall 20. The substrate is preferably mounted in thermal communication with the enclosure to aid in the dissipating heat generated by the LEDs. The LEDs 18 are configured as a linear array with the LEDs 18 being equally spaced along the length of a respective side wall 20. In the exemplary embodiment the LEDs 18 are located at the midpoint of the wall 20 and are oriented such that their axis of emission 22 is generally parallel with the base 14 of the enclosure; that is the axis 22 of emission of each LED is substantially parallel with the light emission plane 16. In terms of orientation the LEDs 18 can be considered to be configured in a manner that is similar to an edge-lit lighting panel though in the lamp of the invention light propagates in free space as opposed to being guided within an optical medium.

A first light reflective surface in the form of a convex cylindrical light reflective surface (convex cylindrical mirror) 24 is provided on the enclosure base 14. The light reflective surface 24 substantially covers the surface area of the housing floor 14. In FIG. 2 the light reflective surface 24 is indicated by a heavy solid line and comprises an arcuate surface extending between the side walls 20 of the enclosure on which the LEDs 18 are located. To ensure a uniform emission of light the light reflective surface 24 is symmetrical in form with the highest portion, measured with respect to the base 14, being located at the midpoint between the side walls 20. In the example shown the height of the light reflective surface 24 at the midpoint lies on or is just below the emission axis 22 of the LEDs 18.

The lamp 10 further comprises light reflective surfaces (mirrors) 26, 28, 30, 32 each of which run along the length of each side wall 20 of the enclosure. The light reflective surfaces 26, 28, 30, 32 are planar in form and are grouped as two pairs with a first pair 26, 28 located above (FIG. 2) the axis 22 and extend between the wall 20 and base 14 and a second pair 30, 32 located below the axis 22 between the wall 20 and the light emission plane 16. As illustrated the mirrored surfaces 26, 28 are contiguous and are respectively oriented at angles of approximately 20° and 50° to the side wall 20. The light reflective surface 30 is oriented at an angle of approximately 50° to the side wall 20 whilst the light reflective surface 32 is generally parallel with the side wall 20.

To maximize emission of light from the lamp all of the inner surfaces of the enclosure, in particular the end walls, are mirrored (light reflective) 34. Each of the light reflective surfaces 24, 26, 28, 30, 32, 34 can comprise a metallization layer of for example aluminum, chromium or silver or a white painted surface. The reflectance of the light reflective surfaces is as high as possible and is preferably greater than 90%, typically greater that 95% and more preferably greater than 98%.

The path by which light is travels to reach the light emission plane 16 determines the angle at which light is emitted from the lamp. In FIGS. 1 and 2 lines 36, 38, 40, 42, 44 indicate the main light paths by which light can reach the light emission plane in which:

36 indicates paths for light that is emitted directly from the LEDs without reflection by any of the light reflective surfaces;

38 indicates paths for light reflected by the first (convex cylindrical) light reflective surface 24 only;

40 indicates a path for light reflected by the light reflective surface 32 on the opposite side wall to the LED;

42 indicates a path for light reflected firstly by the first light reflective surface 24 and then by the light reflective surface 32 on the opposite wall to the LED; and

44 indicates a path for light reflected firstly by the light reflective surface 30 adjacent to the LED and then by the light reflective surface 28.

For ease of understanding only light paths are indicated in FIG. 1 for light emitted by the right hand LEDs. Moreover, only light paths are indicated that lie in a plane that is orthogonal to the side wall 20 and base 14 though it will be appreciated that due to the emission pattern of the LEDs 18 other paths exist which will impinge on the end wall light reflective surface 34. As can be seen from FIGS. 1 and 2, in particular light path 44, the light reflective surfaces 30 and 32 together prevent the direct emission of much of the light that is emitted below the axis 22 (i.e. in a direction towards the light emission plane 16—FIG. 2) at angles greater than 30° to the emission plane. The light reflective surfaces 24, 26, 28, 30, 32, 34 are configured such that they collectively promote a substantially uniform emission of light through the light emission plane 16. Initial tests indicate that by careful configuration of the light reflecting surfaces the variation in luminous intensity across the light emission plane is typically less than ±8% and that of order of 90% of the total light is emitted from the lamp.

A particular advantage of a lamp in accordance with the invention, as compared with a conventional back-lit lamp, in which a plurality of light sources is distributed over the base of the enclosure, is a reduction in overall thickness (height) "h" of the lamp. A further benefit of the lamp of the invention is that it can produce a substantially uniform light emission intensity over the light emission plane 16.

Figure 3:
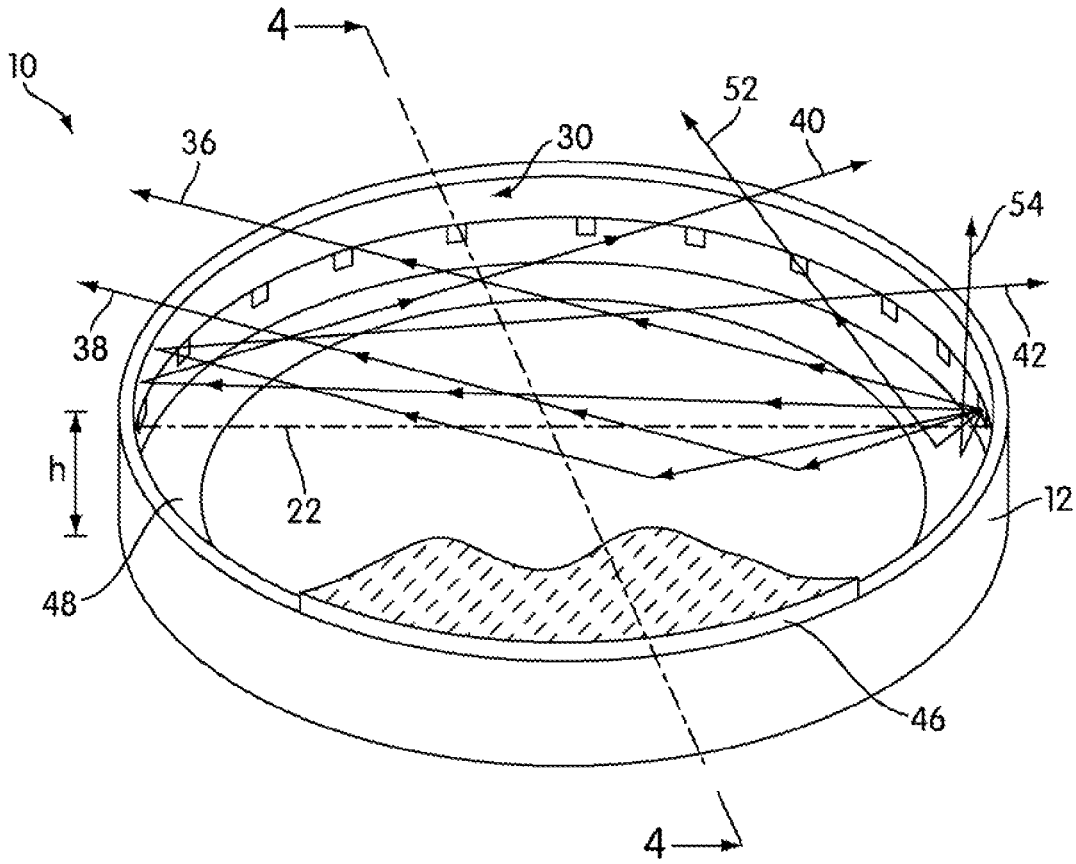
FIG. 3 is a perspective schematic of a lamp in accordance with a second embodiment of the invention.
Figure 4:
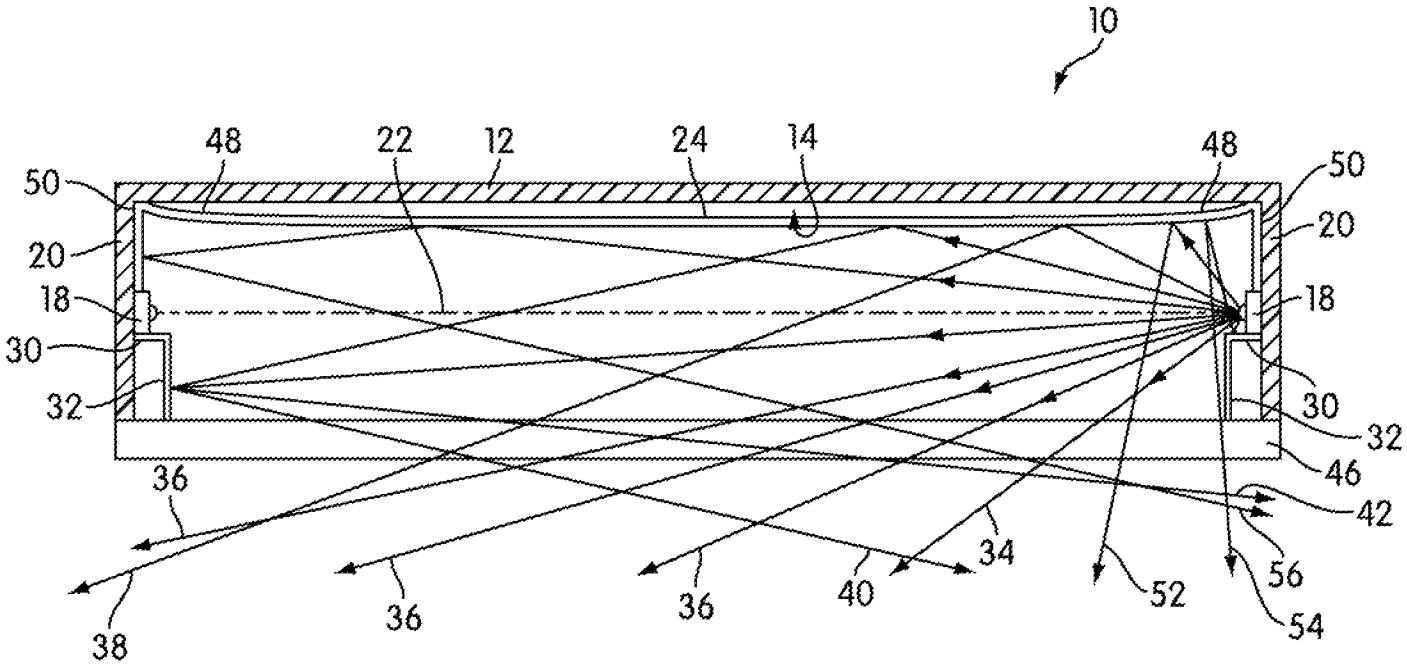
FIG. 4 is sectional schematic of the lamp of FIG. 3 through a line A-A.

An LED based lamp 10 in accordance with a second embodiment of the invention is now described with reference to FIGS. 3 and 4 in which FIG. 3 is a schematic partial cutaway perspective view of the lamp and FIG. 4 is a schematic sectional view through a line A-A. In this embodiment the lamp 10 is circular in form and is intended to be mounted on a ceiling, wall or other generally planar surface. The lamp 10 is configured to generate white light with a CCT of ≈3000° K, an emission luminous intensity of 400 lumens (lm) and an emission angle of order 120°.

In this second embodiment the enclosure 12 comprises a shallow circular tray with a light transmissive (transparent) window (cover) 46 overlying the enclosure opening (light emission plane) 16. The first light reflective surface 24 is circular and generally planar in form with a circumferential annular beveled (chamfered) light reflective portion 48. The first light reflective surface 24 is much shallower that that of the equivalent surface in the first embodiment. A light reflective surface 50 is provided on the circumferential side wall 20 between the base and LEDs 18. In a similar fashion to the first embodiment the light reflective surfaces 30, 32 are configured to prevent light being emitted directly (i.e. without reflection) from the lamp for light that is emitted by the LEDs at angles greater than 30° to the light emission plane 16.

In FIGS. 3 and 4 the lines 36, 38, 40, 42, 52, 54, 56 indicate examples of paths by which light can reach the light emission plane 16 in which:

36 indicates paths for light that is emitted directly from the LEDs without reflection by any of the light reflective surfaces;

38 indicates a path for light reflected by the first light reflective surface 24 only;

40 indicates a path for light reflected by the light reflective surface 32 located on the opposite wall to the LED;

42 indicates a path for light reflected firstly by the first light reflective surface 24 and then by the light reflective surface 32 on the opposite wall to the LED;

52 indicates a path for light reflected by the annular light reflective surface 48 only;

54 indicates a path for light reflected firstly by the light reflective surface 30 adjacent to the LED and then by the annular light reflective surface 48; and

56 indicates a path for light reflected by the first light reflective surface 24 and then by the portion of the light reflective surface 50 opposite to the LED.

Figure 5:
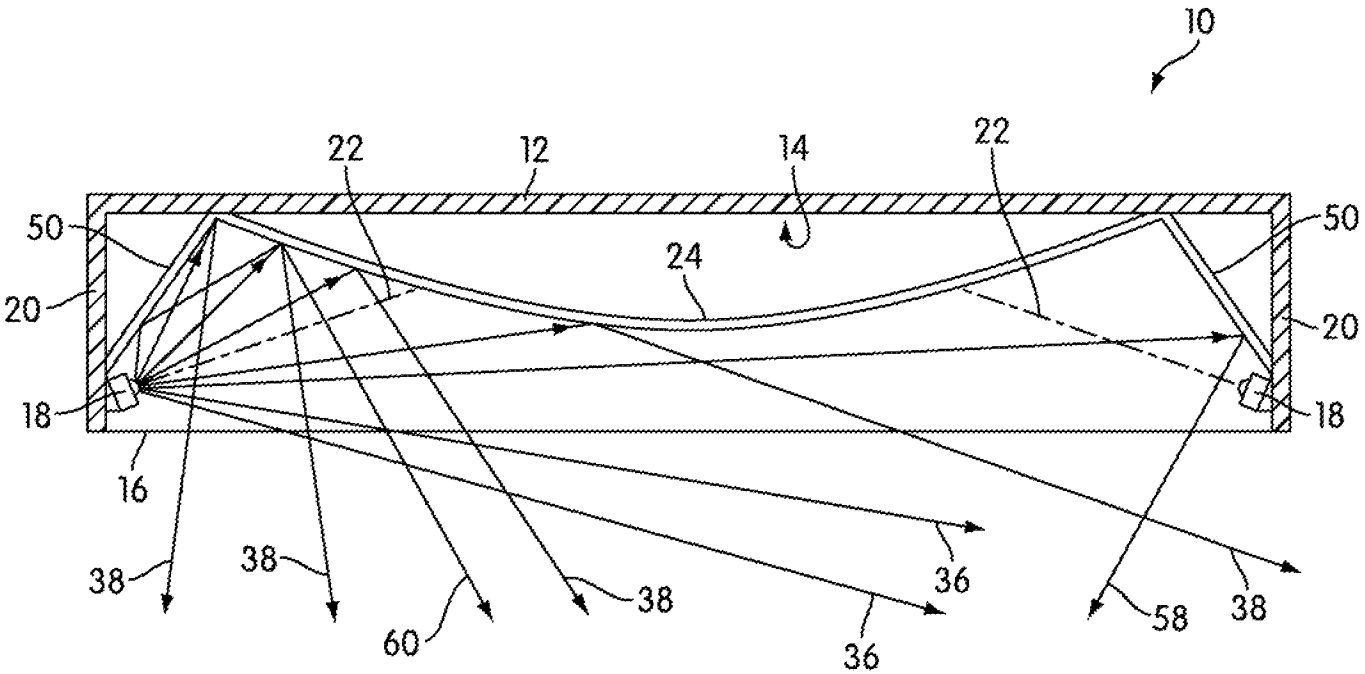
FIG. 5 is a sectional schematic of a lamp in accordance with a third embodiment of the invention.

An LED based lamp 10 in accordance with a third embodiment of the invention is now described with reference to FIG. 5 which shows a schematic sectional view of the lamp. In this embodiment the enclosure comprises a square tray and the LEDs 18 are oriented such that their axis 22 of emission is directed away from light emission plane 16 and towards the first light reflective surface 24. As shown in FIG. 5 the LEDs 18 are oriented at an angle of order 10° away from the emission plane 16 though the angle can typically be in a range 0 to 30°.

In the embodiment shown in FIG. 5 the first light reflective surface 24 is arcuate in form and extends in a direction between the walls 20. The light reflective surface 50 which can be substantially planar or slightly convex extends between the base 14 and the LEDs and is oriented at an angle of 30 to 60° to the base. Since the emission axis 22 of the LEDs 18 is directed away from the light emission plane 16, the light reflective surfaces 30, 32 are no longer required.

In FIG. 5 lines 36, 38, 58, 60 indicate the principal paths by which light reaches the light emission plane 16 in which:

36 indicates paths for light that is emitted directly from the LEDs without reflection by any of the light reflective surfaces;

38 indicates paths for light reflected by the first light reflective surface 24 only;

58 indicates a path for light reflected by the light reflective surface 50 located on the opposite wall to the LED; and

60 indicates a path for light reflected by the light reflective surface 50 adjacent to the LED and then by the first light reflective surface 24.

In each of the embodiments described so far the LEDs 18 are white light emitting devices, "whites LEDs" and incorporate one or more phosphor materials. In further embodiments it is envisaged to provide one or more phosphor materials overlying and/or located at the light emission plane 16 such that it is physically remote to the LED used to excite the phosphor.

An LED based lamp 10 in accordance with a fourth embodiment of the invention is now described with reference to FIG. 6 which shows a schematic sectional view of such a lamp 10. In this embodiment the LEDs 18 comprise blue (450-480 nm) light emitting 1.1 W GaN based LEDs and the light transmissive window (cover) 46 includes one or more layers of one or more phosphor (photo luminescent) materials 62 for generating a required color and/or CCT of emitted light (typically white). As is known the one or more phosphor materials absorb a proportion of the blue light emitted by the LED and emit yellow, green and/or red light. The blue light that is not absorbed by the phosphor material(s) combined with light emitted by the phosphor material(s) gives an emission product that appears white in color. The phosphor material 62, which is typically in powder form, is mixed with a binder material such as NAZDAR's clear screen ink 9700 and the mixture screen printed on the surface of the window to form a layer of uniform thickness "t". It will be appreciated that the phosphor can be applied by other deposition methods such as spraying, ink jet printing or by mixing the powdered phosphor with a light transmissive binder material such as an epoxy or silicone and applying the phosphor/polymer mixture by doctor blading, spin coating etc. To protect the phosphor material 62 the window 46 is preferably mounted with the phosphor layer(s) 62 located on the inside of the enclosure. Typically the weight loading of phosphor material to light transmissive binder in the deposited material is between 10% and 30% though it can range between 1% and 99% depending on the desired emission product. To deposit a sufficient density of phosphor material per unit area, for example 0.02-0.04 g/cm$^2$, it may be necessary to make multiple print passes, the number of passes depending on the mesh size of the printing screen.

The phosphor material(s) can comprise an inorganic or organic phosphor such as for example silicate-based phosphor of a general composition $A_3Si(O,D)_5$ or $A_2Si(O,D)_4$ in which Si is silicon, O is oxygen, A comprises strontium (Sr), barium (Ba), magnesium (Mg) or calcium (Ca) and D comprises chlorine (Cl), fluorine (F), nitrogen (N) or sulfur (S). Examples of silicate-based phosphors are disclosed in our co-pending patent applications U.S. 2006/0145123 (Europium activated silicate-based green phosphor), US2006/0261309 (two phase silicate-based yellow phosphor), US2007/0029526 (silicate-based orange phosphor) and U.S. Pat. No. 7,311,858 (silicate-based yellow-green phosphor) the specification and drawings of each of which is incorporated herein by reference. The phosphor can also comprise an aluminate-based material such as is taught in our co-pending patent application US2006/0158090 (aluminate-based green phosphor) and U.S. Pat. No. 7,390,437 (aluminate-based blue phosphor), an aluminum-silicate phosphor as taught in co-pending application US2008/0111472 (aluminum-silicate orange-red phosphor) or a nitride-based red phosphor material such as is taught in our co-pending provisional patent application No. 61/054,399 the specification and drawings of each of which is incorporated herein by reference. It will be appreciated that the phosphor material is not limited to the examples described herein and can comprise any phosphor material including nitride and/or sulfate phosphor materials, oxy-nitrides and oxy-sulfate phosphors or garnet materials (YAG).

An advantage of providing the phosphor remote to the LEDs is that light generation, photo-luminescence 64, occurs over the entire surface of the window 46 (light emission plane 16) and this can result in a more uniform color and/or CCT of emitted light. Due to the isotropic nature of phosphor photo-luminescence approximately half of the light 64 generated by the phosphor will be emitted in a direction back into the volume 66 of the lamp enclosure. Such light will be reflected by the light reflective surfaces 24, 30, 32, 48 and 50 and eventually emitted through the light emission plane 16. It will be further appreciated that light will be scattered by the phosphor material(s) 62.

A further advantage of locating the phosphor remote to the LEDs is that less heat is transferred to the phosphor material(s), reducing thermal degradation of the phosphor material(s). Additionally the color and/or CCT of the lamp can be changed by changing the phosphor/polymer window 46.

Figure 6:
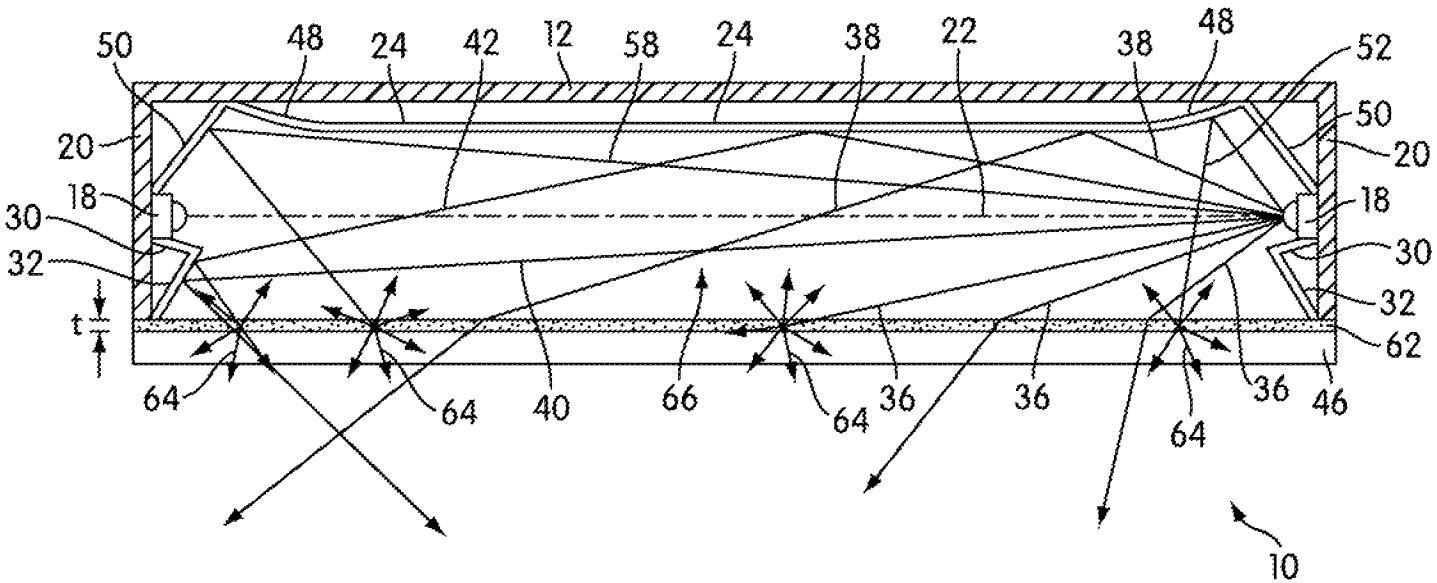
FIG. 6 is a sectional schematic of a lamp in accordance with a fourth embodiment of the invention.

In FIG. 6 lines 36, 38, 40, 42, 58 indicate paths by which light can reach the light emission plane 16 in which:

36 indicates a path for light that is emitted directly from the LEDs without reflection by any of the light reflective surfaces;

38 indicates paths for light reflected by the first light reflective surface 24 only;

40 indicates a path for light reflected by the light reflective surface 32 located on the opposite wall to the LED;

42 indicates a path for light reflected firstly by the first light reflective surface 24 and then by the light reflective surface 32 on the opposite wall to the LED; and

Figure 7:
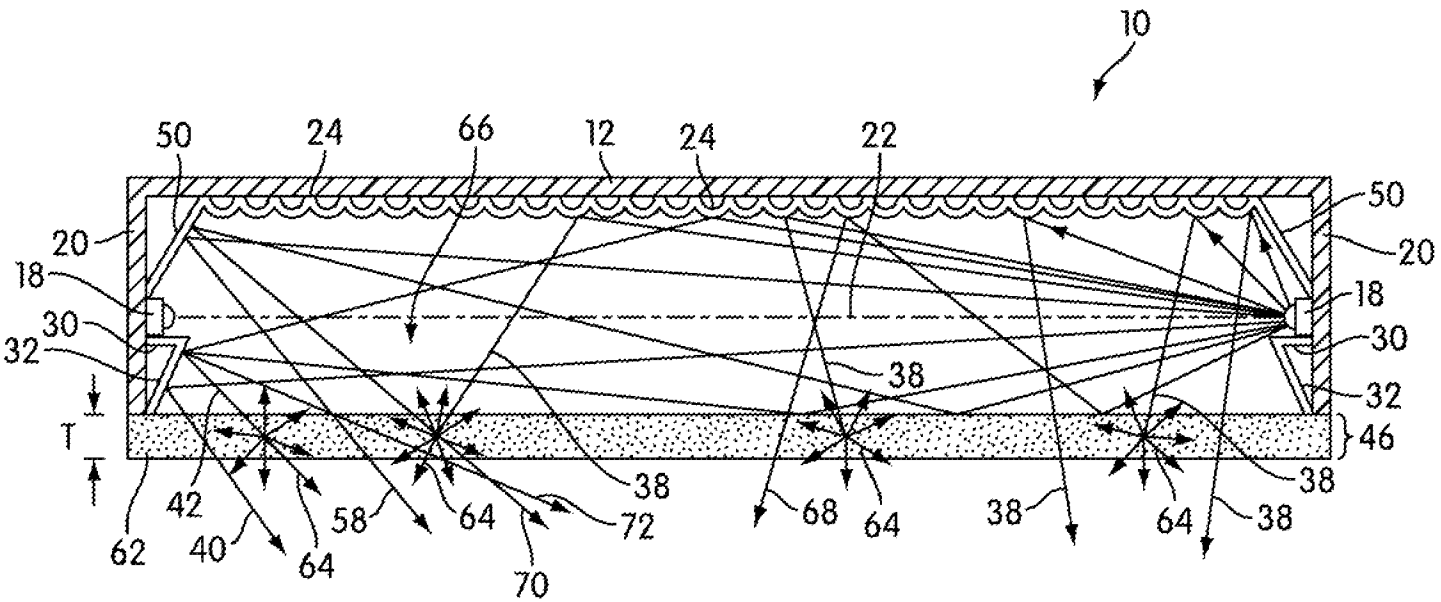
FIG. 7 is a sectional schematic of a lamp in accordance with a fifth embodiment of the invention.

58 indicates a path for light reflected by the light reflective surface 50 located on the opposite wall to the LED;

As shown in FIG. 7 the phosphor material(s) 62 can be incorporated within the window 46. In such an arrangement the powdered phosphor material(s) can be mixed polymer material (for example a polycarbonate, acrylic, silicone, epoxy material, low temperature glass etc) and the phosphor/polymer mixture then extruded to form a homogeneous phosphor/polymer sheet of uniform thickness "T" that has a uniform (homogeneous) distribution of phosphor throughout its volume. The weight ratio loading of phosphor to polymer is typically in a range of 35 to 85 parts per 100 with the exact loading depending on the required CCT of the emission product of the lamp. As in the case of the weight loading of the phosphor to polymer, the thickness "T" of the phosphor loaded window 46 will determine the CCT of light generated by the lamp.

In the embodiment of FIG. 7 the first light reflective surface 24 on the base 14 of the enclosure 12 comprises a series of parallel cylindrical ridges that run in a direction orthogonal the emission axis of the LEDs (i.e. in a direction into and out of the plane of the paper). The light reflective ridges randomize the angle at which light strikes the light transmissive window 46. It will be appreciated that light striking the surface of the window 46 at angles greater than the critical angle will be reflected by the window 46 back into the volume 68 of the enclosure 12. Such light will then reflected by the light reflective surfaces and eventually out through the window. A ridged form of the light reflective surface 24, compared with a substantially planar surface, increases the proportion of light striking the window at the angles below the critical angle and hence increases light emission.

In FIG. 7 the lines 38, 40, 42, 68, 70, 72, 74 indicate paths by which light can reach the light emission plane 16 in which:

38 indicates paths for light reflected by the first light reflective surface 24 only;

40 indicates a path for light reflected by the light reflective surface 32 located on the opposite wall to the LED;

42 indicates a path for light reflected firstly by the light reflective surface 24 and then by the light reflective surface 32 on the opposite wall to the LED;

58 indicates a path for light reflected by the light reflective surface 50 located on the opposite wall to the LED;

68 indicates a path for light reflected firstly by the inner surface of the light transmissive window 46 and then by the first light reflective surface 24;

70 indicates a path for light reflected firstly by the inner surface of the light transmissive window 46 and then by the light reflective surface 32 on the opposite wall to the LED; and

72 indicates a path for light reflected firstly by the inner surface of the light transmissive window 46 and then by the light reflective surface 50 on the opposite wall to the LED.

Figure 8:
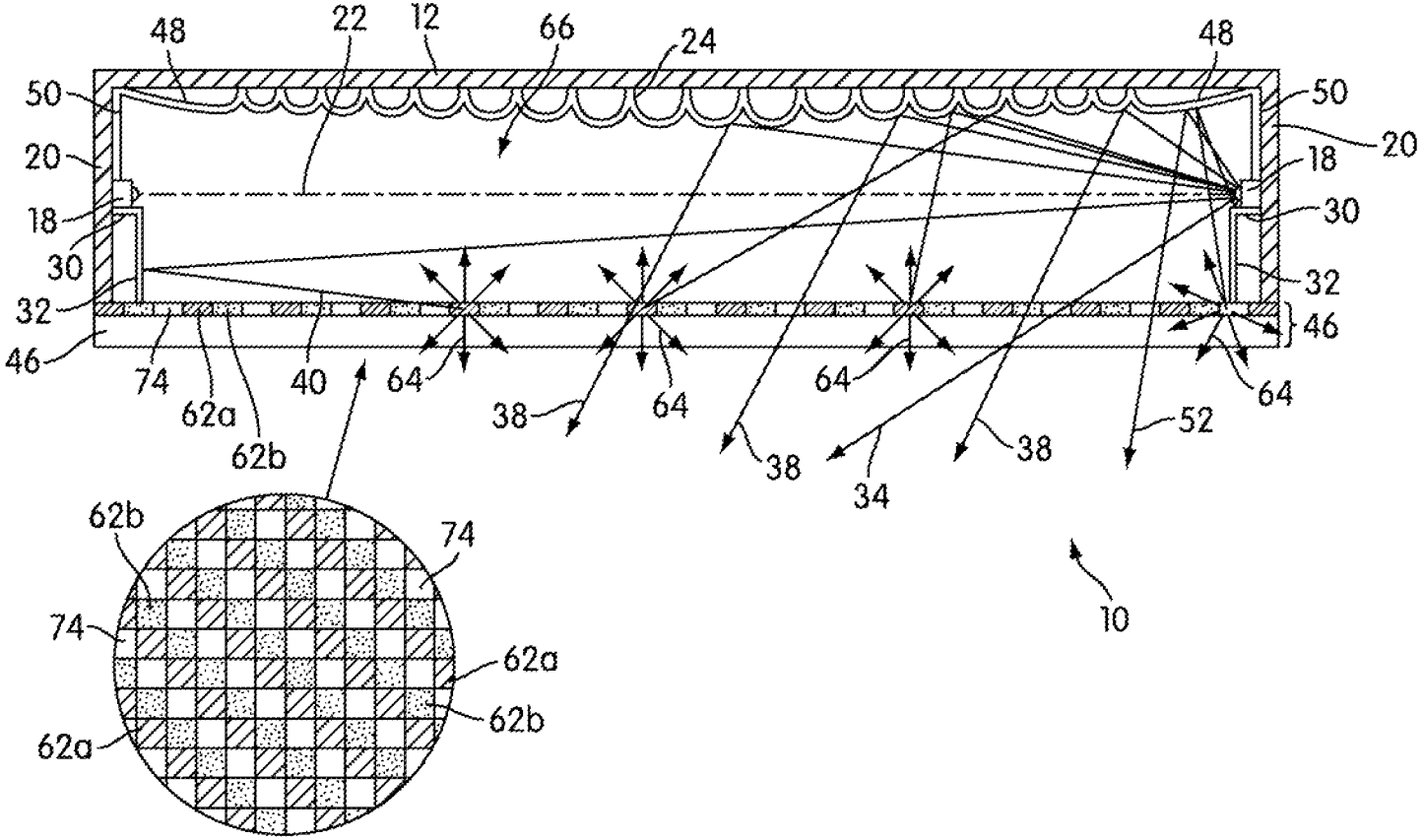
FIG. 8 is a sectional schematic of a lamp in accordance with a sixth embodiment of the invention.

An LED based lamp 10 in accordance with a sixth embodiment of the invention is now described with reference to FIG. 8 which shows a schematic sectional view of such a lamp. As shown in FIG. 8 and as disclosed in co-pending U.S. patent application Ser. No. 11/975,130 (filed Oct. 17, 2007), the specification and drawings of which is incorporated herein by reference, the phosphor material(s) can be patterned such as to include a pattern of windows (i.e. areas with no phosphor material) which are transmissive to light generated by the LEDs and light generated by the phosphor. Such an arrangement can increase overall light emission from the lamp. In FIG. 8 the phosphor material is provided as a checkered pattern of two different phosphor materials 62*a*, 62*b* (e.g. green and orange light emitting phosphors). In other arrangements the phosphor material can be provided as a square array of square shaped phosphor regions that are separated from one another other by a window 76 in the form of a square grid. In another arrangement it is envisaged to provide the phosphor material as a layer covering the entire surface of the light transmissive window 46 and which includes a regular array (e.g. square or hexagonal array) of circular or other shaped windows 76. Other phosphor patterns will be apparent to those skilled in the art.

In FIG. 8 the lines 38, 40, 52 indicate paths by which light can reach the light emission plane 16 in which:

38 indicates paths for light reflected by the first light reflective surface 24 only; and

40 indicates a path for light reflected by the light reflective surface 32 located on the opposite wall to the LED; and

52 indicates a path for light reflected by the light reflective surface 48 only.

Figure 9:
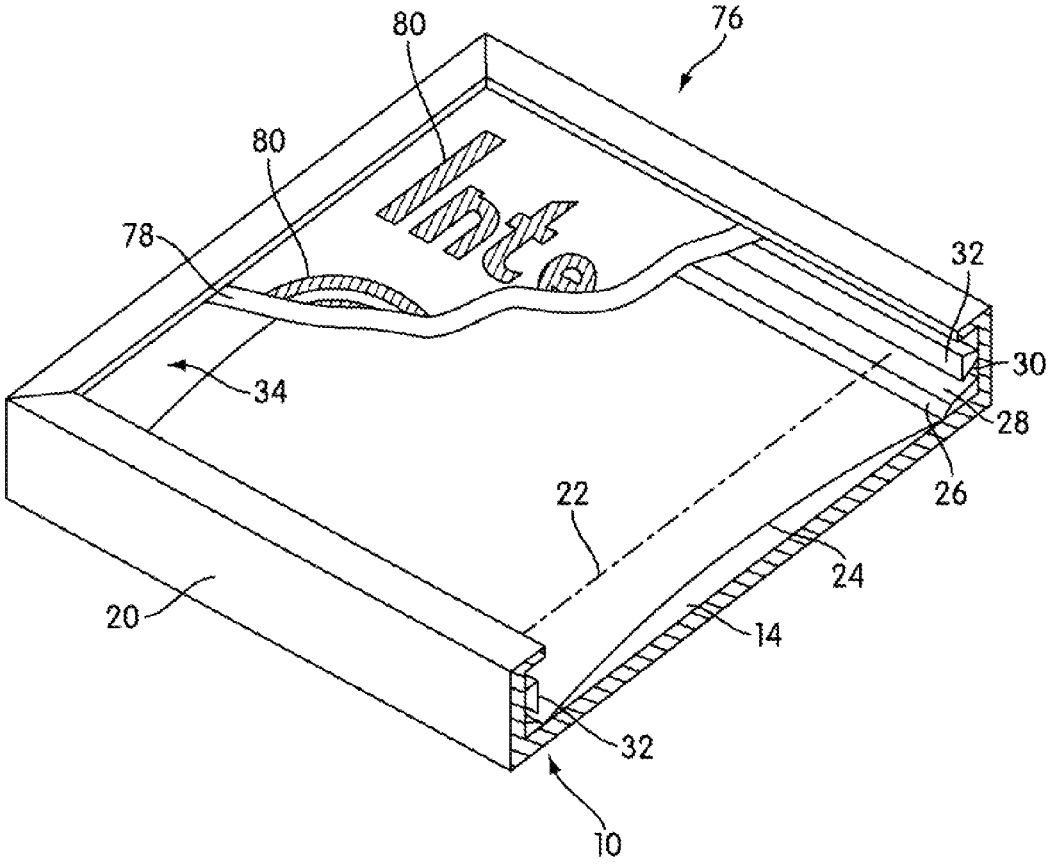
FIG. 9 is a perspective partial cutaway schematic of a light emitting sign in accordance with an embodiment of the invention.

Whilst the invention arose in relation to a wall or ceiling mountable panel lamp, the lamp of the invention is suited to other applications and in particular as a back-light (light box) in a light emitting sign. An example of a light emitting sign 76 in accordance with the invention is shown in FIG. 9 and comprises a light transmissive display surface 80 positioned at the light emission plane 16 that includes a numeral(s), letter(s), device, insignia, indicia, symbol(s) or other display information 80 is. As illustrated the back-light 10 can comprise the lamp of FIGS. 1 and 2.

It is envisaged in other embodiments that the lamp comprise blue light emitting diodes 18 and the display surface 80 further comprise one or more phosphor materials that are provided as a pattern to generate the required light emitting indicia or symbols. Alternatively, the back-light 10 can generate white light and the display image comprise pattern of light transmissive color symbol(s). Examples of such signs include light emitting exit signs, pedestrian crossing "walk" and "stop" signs, traffic signs, advertising signage (billboards) etc. Examples of back-lit light emitting signs are disclosed in our co-pending patent application Ser. No. 11/714,711 (Publication US 2007/0240346) filed Jun. 3, 2007 the specification and drawings of which is incorporated herein by reference.

The lamp and light emitting sign of the invention is not restricted to the specific embodiment described and variations can be made that are within the scope of the invention. For example, lamps in accordance with the invention can comprise other LEDs such as silicon carbide (SiC), zinc selenide (ZnSe), indium gallium nitride (InGaN), aluminum nitride (AlN) or aluminum gallium nitride (AlGaN) based LED chips that emit blue or U.V. light.

Moreover the light reflective surface located on the base of the housing can have other forms such as being an oblate hemi-spheroidal surface or an ellipsoidal surface.

What is claimed is:

1. An apparatus, comprising:

an enclosure with an opening that comprises a light emission plane through which light is emitted from the lamp;

a plurality of light emitting diodes located along at least one wall of the enclosure and operable to generate first light of a first wavelength range, wherein the plurality of light emitting diodes are configured such that in operation their emission axis is oriented within a plane that is substantially parallel with or directed away from the light emission plane;

a first light reflective surface located on the base of the enclosure having a convex shape and configured such that the first light is reflected off the first light reflective surface to disperse the first light at a plurality of different angles relative to the light emission plane; and one or more phosphor elements to absorb at least a portion of the first light emitted from the plurality of light emitting diodes to re-emit second light having a second wavelength range.

2. The apparatus according to claim 1, wherein the emission axis of the light emitting diodes is oriented at an angle in a range 0° to 30° to the light emission plane.

3. The apparatus according to claim 1, wherein the first light reflective surface is configured such that a variation in luminous emission intensity over the light emission plane is less than 10%.

4. The apparatus according to claim 1, and further comprising a second light reflective surface configured to prevent at least a portion of the light emitted by the light emitting diodes being emitted directly through the light emission plane.

5. The apparatus according to claim 4, wherein the second light reflective surface is configured to prevent light emitted at angle of more than 30° to the light emission plane being emitted directly.

6. The apparatus according to claim 1, wherein the first light reflective surface is arcuate and extends between walls of the enclosure.

7. The apparatus according to claim 6, wherein the first light reflective surface is selected from the group consisting of: a convex cylindrical surface that extends between opposite walls of the enclosure on which the light emitting diodes are located, an oblate hemi-spheroidal surface and ellipsoidal surface.

8. The apparatus according to claim 1, wherein the first light reflective surface is substantially planar and is oriented substantially parallel with the light emission plane.

9. The apparatus according to claim 8, wherein the first light reflective surface further comprises at least one light reflective portion that is oriented at an angle to the light emission plane.

10. The apparatus according to claim 2, wherein the second light reflective surface extends out from the wall on which the light emitting diodes are located.

11. The apparatus according to claim 1 or claim 4, wherein the light reflective surfaces have a reflectance selected from the group consisting of: at least 90%, at least 95% and at least 98%.

12. The apparatus according to claim 1, wherein the enclosure is quadrilateral in form and the light emitting diodes are located on opposite walls of the enclosure and wherein the first light reflective surface comprises a convex cylindrical surface that extends between the walls on the enclosure on which the light emitting diodes are located.

13. The apparatus according to claim 1, wherein the enclosure is quadrilateral in form and the light emitting diodes are located on opposite walls of the enclosure and wherein the first light reflective surface comprises a substantially planar surface that extends between the walls on the enclosure on which the light emitting diodes are located.

14. The apparatus according to claim 1, wherein the enclosure is circular in form and the light emitting diodes are spaced around the wall and wherein the first light reflective surface comprises an oblate hemi-spheroidal surface located on the base of the enclosure.

15. The apparatus according to claim 1, and further comprising at least one phosphor material operable to absorb at least a portion of light of the first wavelength range and to emit light of a second wavelength range, wherein the at least one phosphor material is provided at the light emission plane.

16. The apparatus according to claim 15, and further comprising a light transmissive window overlying the light emission plane and wherein the at least one phosphor material is incorporated in the light transmissive window.

17. The apparatus according to claim 16, wherein the at least one phosphor material is distributed substantially uniformly throughout the volume of the light transmissive window.

18. The apparatus according to claim 15, and further comprising a light transmissive window overlying the light emission plane and wherein the at least one phosphor material comprises at least one layer on at least a part of the surface of the light transmissive window.

19. The apparatus according to claim 15, and further comprising a pattern of regions without phosphor material.

20. The apparatus according to claim 1, wherein light emitted by the lamp comprises a combination of light of the first and second wavelength ranges.

21. The apparatus according to claim 20, wherein light emitted by the lamp appears white in color.

22. The apparatus according to claim 16 or claim 18, wherein the light transmissive window is selected from the group consisting of being: planar and arcuate in form.

23. The apparatus according to claim 1, wherein the light emitting diodes are operable to emit light that appears white in color.

24. The apparatus according to claim 1, further comprising a light transmissive display surface overlying the light emission plane.

25. The apparatus according to claim 24 and further comprising at least one phosphor material located on the display surface and operable to absorb at least a portion of light of the first wavelength range and to emit light of a second wavelength range.

26. The apparatus according to claim 25, wherein the at least one phosphor is configured as a pattern representative of display information.

* * * * *